US011305409B2

(12) United States Patent
Chien

(10) Patent No.: US 11,305,409 B2
(45) Date of Patent: Apr. 19, 2022

(54) RETRIEVING DEVICE AND IMPACT MECHANISM FOR AN ELECTRIC NAIL GUN HAVING THE SAME

(71) Applicant: BASSO INDUSTRY CORP., Taichung (TW)

(72) Inventor: Chia-Yu Chien, Taichung (TW)

(73) Assignee: BASSO INDUSTRY CORP., Taichung (TW)

( * ) Notice: Subject to any disclaimer, the term of this patent is extended or adjusted under 35 U.S.C. 154(b) by 62 days.

(21) Appl. No.: 16/751,898

(22) Filed: Jan. 24, 2020

(65) Prior Publication Data

US 2020/0246952 A1 Aug. 6, 2020

(30) Foreign Application Priority Data

Feb. 1, 2019 (TW) ..... 108104057

(51) Int. Cl.
*B25C 1/06* (2006.01)
*B25D 11/02* (2006.01)

(52) U.S. Cl.
CPC ..... *B25C 1/06* (2013.01); *B25D 11/02* (2013.01); *B25D 2216/0069* (2013.01)

(58) Field of Classification Search
CPC ... B25D 11/02; B25D 2216/0069; B25C 1/06; B25C 5/15
USPC ..... 277/131, 133
See application file for complete search history.

(56) References Cited

U.S. PATENT DOCUMENTS 5,138,496 A * 8/1992 Pong ..... G02B 7/023 327/544
2009/0250500 A1* 10/2009 Brendel ..... B25C 1/06 227/132
2014/0076951 A1* 3/2014 Brendel ..... B25C 1/06 227/8
2014/0076952 A1* 3/2014 Garber ..... B25C 1/06 227/129
2014/0097223 A1* 4/2014 Baron ..... B25C 5/15 227/131
2015/0251300 A1* 9/2015 Po ..... B25C 1/06 227/132
2019/0299380 A1* 10/2019 Meyer ..... B25C 1/008
2020/0238491 A1* 7/2020 Chien ..... B25C 1/008
2020/0246951 A1* 8/2020 Chien ..... B25C 1/06
2020/0246952 A1* 8/2020 Chien ..... B25C 1/06
2021/0122019 A1* 4/2021 Lai ..... B25C 5/15

FOREIGN PATENT DOCUMENTS

TW M482482 U 7/2014

* cited by examiner

*Primary Examiner* — Andrew M Tecco
(74) *Attorney, Agent, or Firm* — Burris Law, PLLC

(57) ABSTRACT

A retrieving device is adapted to be installed in an electric nail gun. The retrieving device includes at least one stationary seat that is adapted to be connected to a swing arm of the nail gun and that has at least one stationary elongated hole being elongated in an extending direction, at least one moving seat that is adapted to be co-movably connected to a movable impact member of the nail gun, and at least one resilient member that interconnects the at least one stationary seat and the at least one moving seat, and that has at least one first end coil extending through the at least one stationary elongated hole and being movable parallel to the extending direction along the at least one stationary elongated hole.

16 Claims, 10 Drawing Sheets

RETRIEVING DEVICE AND IMPACT MECHANISM FOR AN ELECTRIC NAIL GUN HAVING THE SAME

CROSS-REFERENCE TO RELATED APPLICATION

This application claims priority of Taiwanese Patent Application No. 108104057, filed on Feb. 1, 2019.

FIELD

The disclosure relates to an electric nail gun, and more particularly to an impact mechanism for an electric nail gun that has a retrieving device.

BACKGROUND

Referring to FIGS. 1 and 2, a conventional electric nail gun 1 disclosed in Taiwanese Utility Model Patent No. M482482 includes a machine body 11, a flywheel 12, a motor unit 13, a swing arm 14, an impact member 15, a slide block 16, two first resilient members 17 and a second resilient member 18.

The flywheel 12 is rotatably mounted to the machine body 11. The motor unit 13 is mounted to the machine body 11 to drive the flywheel 12 to rotate. The swing arm 14 is connected to the machine body 11, and is pivotable relative to the machine body 11. The impact member 15 is slidably mounted to the swing arm 14. The slide block 16 is slidably mounted to the impact member 15. The first resilient members 17 are connected between the slide block 16 and the swing arm 14, and the second resilient member 18 is connected between the slide block 16 and the impact member 15.

When in operation, the swing arm 14 is pivoted to move the impact member 15 to contact the flywheel 12, such that rotation of the flywheel 12 drives the impact member 15 to move forward. When the impact member 15 moves forward, it compresses the second resilient member 18, and also pushes the slide block 16 to move forward. At the same time, the first resilient members 17 is stretched by the slide block 16. In such a manner, the slide block 16 is subjected to opposite biasing forces exerted respectively by the first and second resilient members 17, 18 (i.e. one biasing force in a direction of the movement and the other opposite to the direction of the movement). Such configuration aims to dampen an impact of abrupt stretching of the first resilient members 17, and to increase the lifespan of the first resilient members 17. However, there is still room for improvement.

SUMMARY

Therefore, an object of the disclosure is to provide a retrieving device for an electric nail gun that serves as an alternative to the prior art for increasing lifespan of a resilient element used in the electric nail gun.

Accordingly, a retrieving device is adapted to be installed in an electric nail gun. The electric nail gun includes a main frame, a flywheel that is rotatably mounted to the main frame, and an impact mechanism. The impact mechanism includes a swing arm connected to the main frame, and an impact member slidably mounted to the swing arm. The swing arm is pivotable relative to the main frame to move the impact member to contact the flywheel so that rotation of the flywheel drives the impact member to move forward along an axis from a normal position to a striking position.

The retrieving device includes at least one stationary seat, at least one moving seat and at least one resilient member.

The at least one stationary seat is adapted to be connected to the swing arm, and has at least one stationary elongated hole being elongated in an extending direction of the axis. The at least one moving seat is adapted to be co-movably connected to the impact member, and is spaced apart from the at least one stationary seat in the extending direction. The at least one resilient member interconnects the at least one stationary seat and the at least one moving seat, and has at least one first end coil extending through the at least one stationary elongated hole and being movable parallel to the axis along the at least one stationary elongated hole.

Another object of the disclosure is to provide an impact mechanism for an electric nail gun that includes the above-mentioned retrieving device.

Accordingly, an impact mechanism is adapted to be installed in an electric nail gun. The electric nail gun includes a main frame and a flywheel that is rotatably mounted to the main frame.

The impact mechanism includes a swing arm, an impact member and the above-mentioned retrieving device.

The swing arm is adapted to be connected to the main frame. The impact member is slidably mounted to the swing arm. The swing arm is adapted to be pivotable relative to the main frame to move the impact member to contact the flywheel so that rotation of the flywheel drives the impact member to move forward along an axis from a normal position to a striking position. The retrieving device is connected to the swing arm and the impact member.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
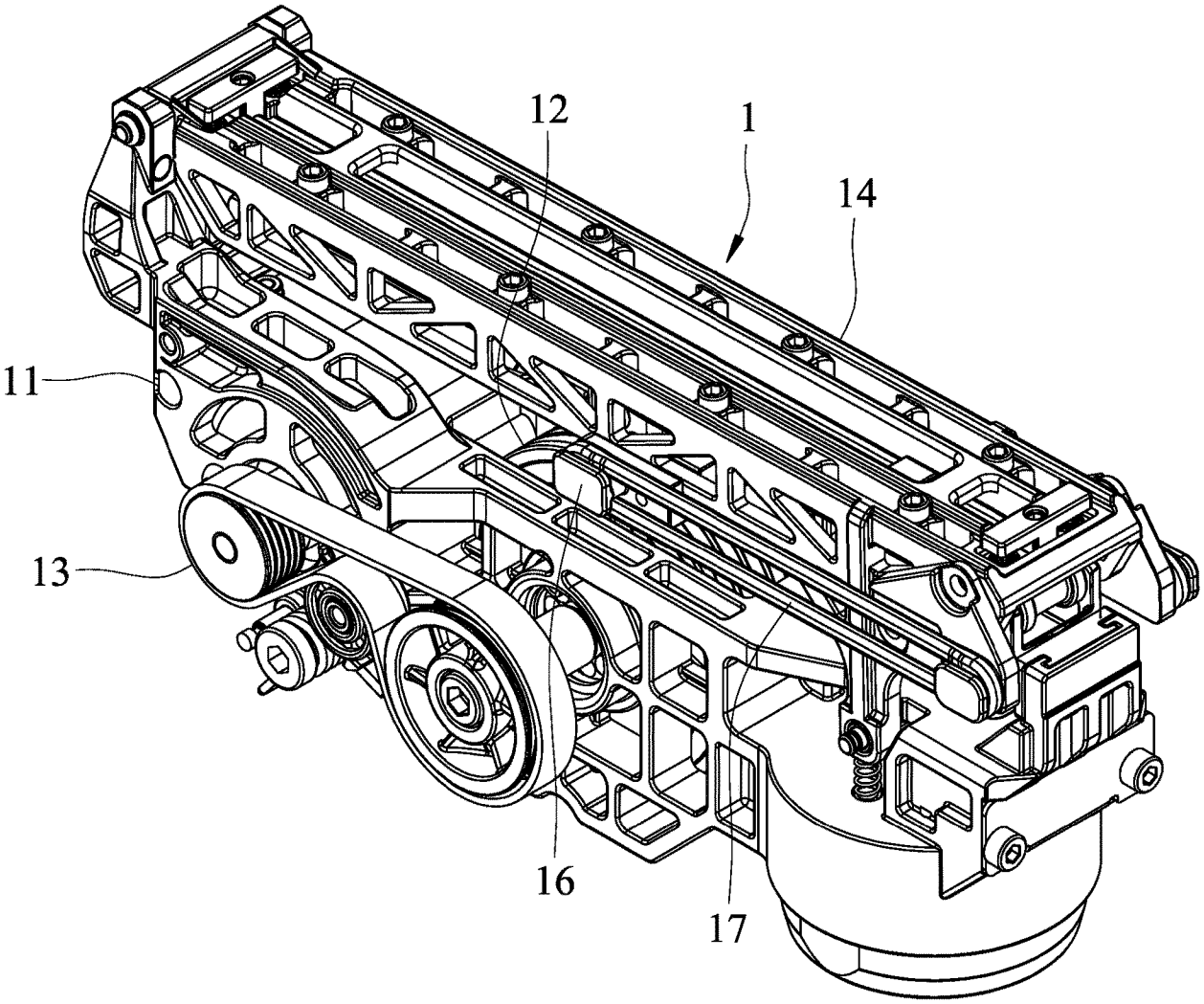
FIG.1 PRIOR ART
FIG. 1 is a perspective view of a conventional electric nail gun disclosed in Taiwanese Utility Model Patent No. M482482.
Figure 2:
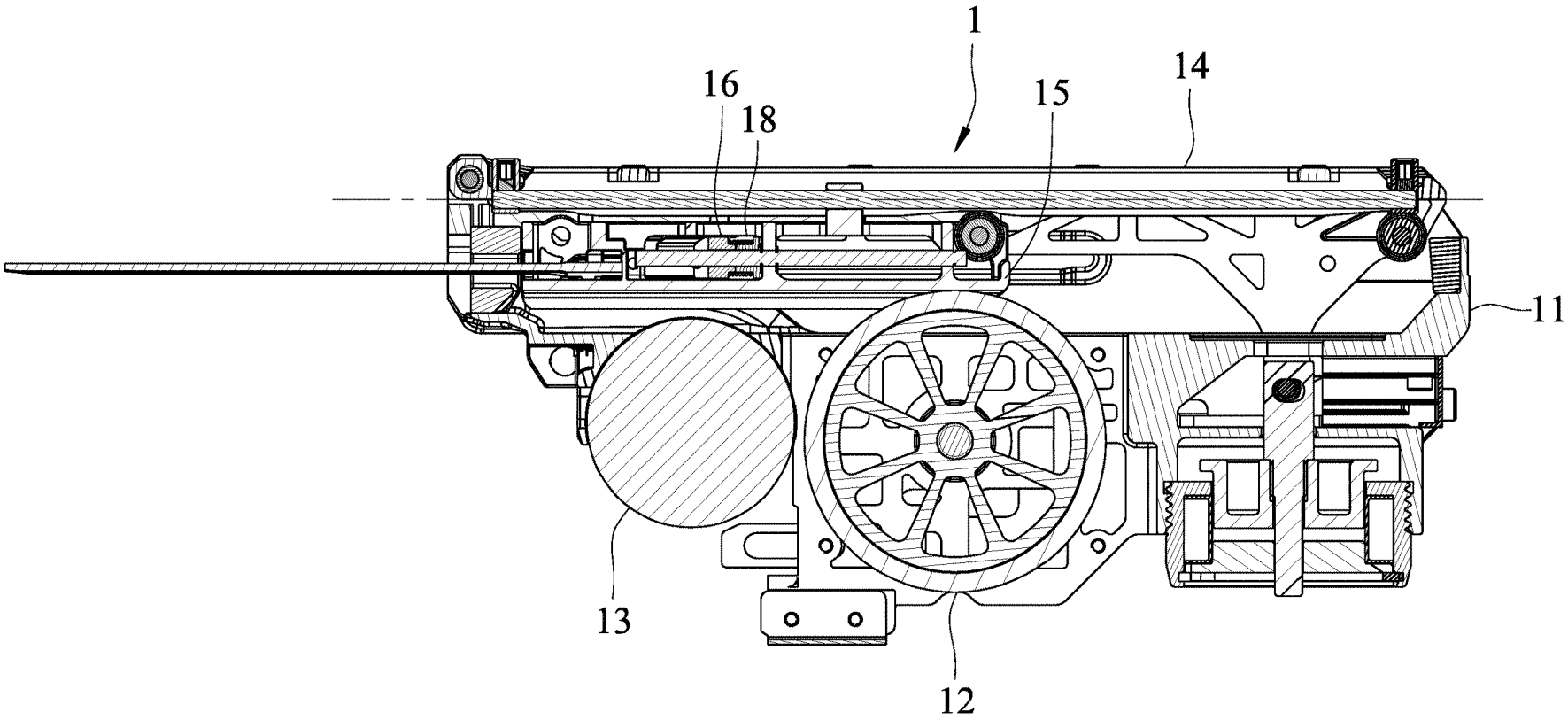
FIG.2 PRIOR ART
FIG. 2 is a sectional view of the conventional electric nail gun.
Figure 3:
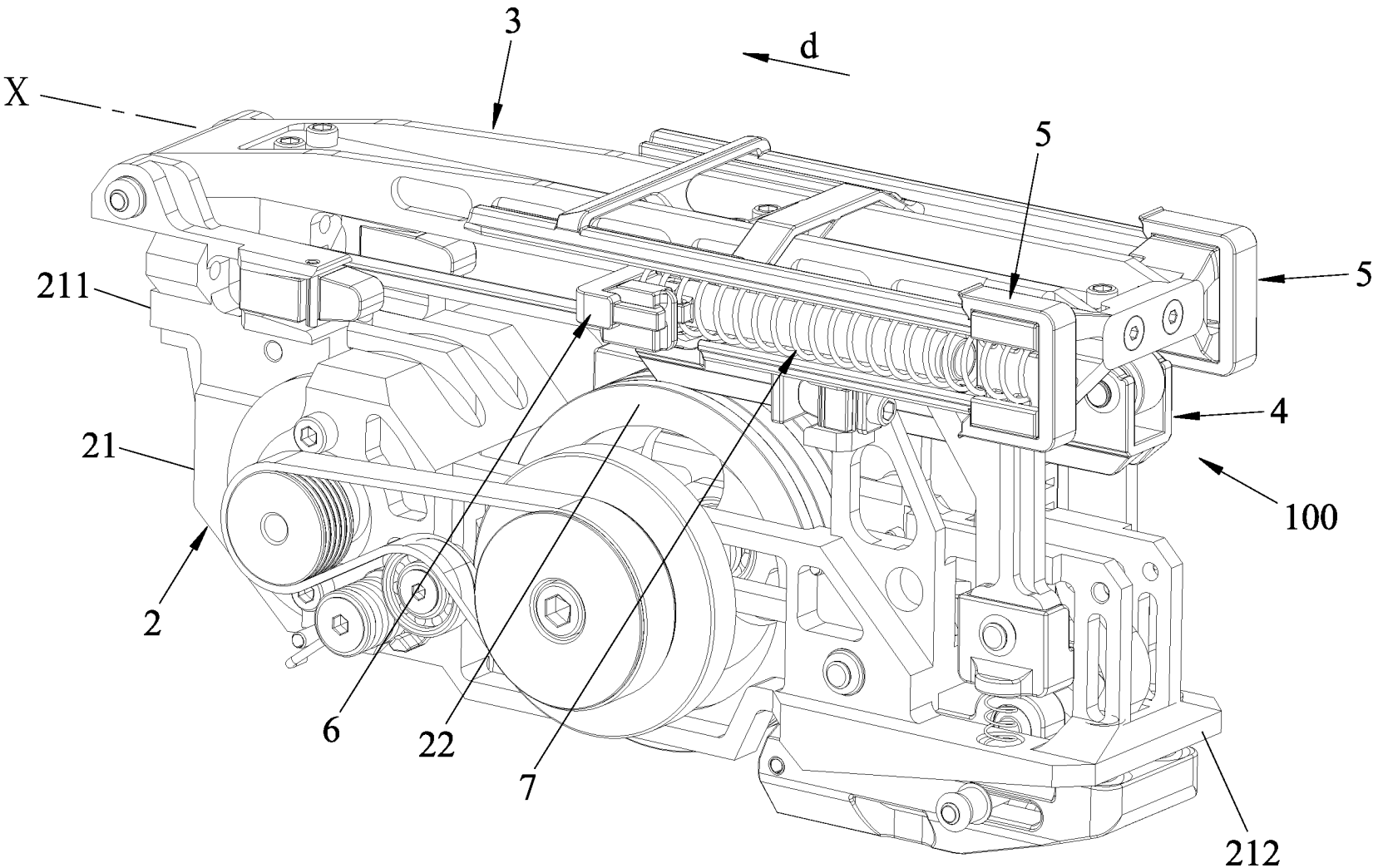
FIG. 3 is a perspective view of an electric nail gun mounted with an embodiment of an impact mechanism according to the disclosure.
Figure 4:
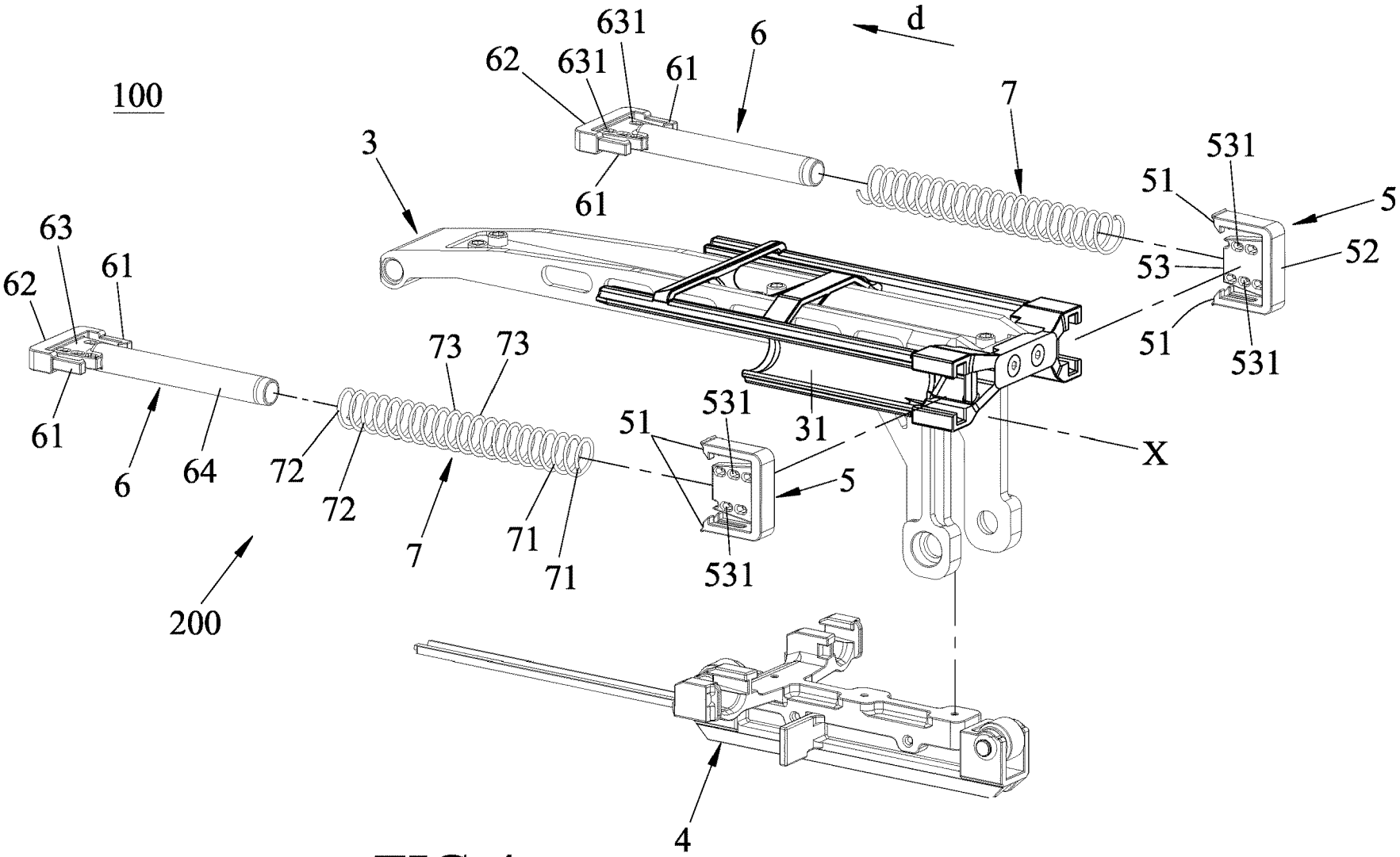
FIG. 4 is an exploded perspective view of the embodiment.
Figure 5:
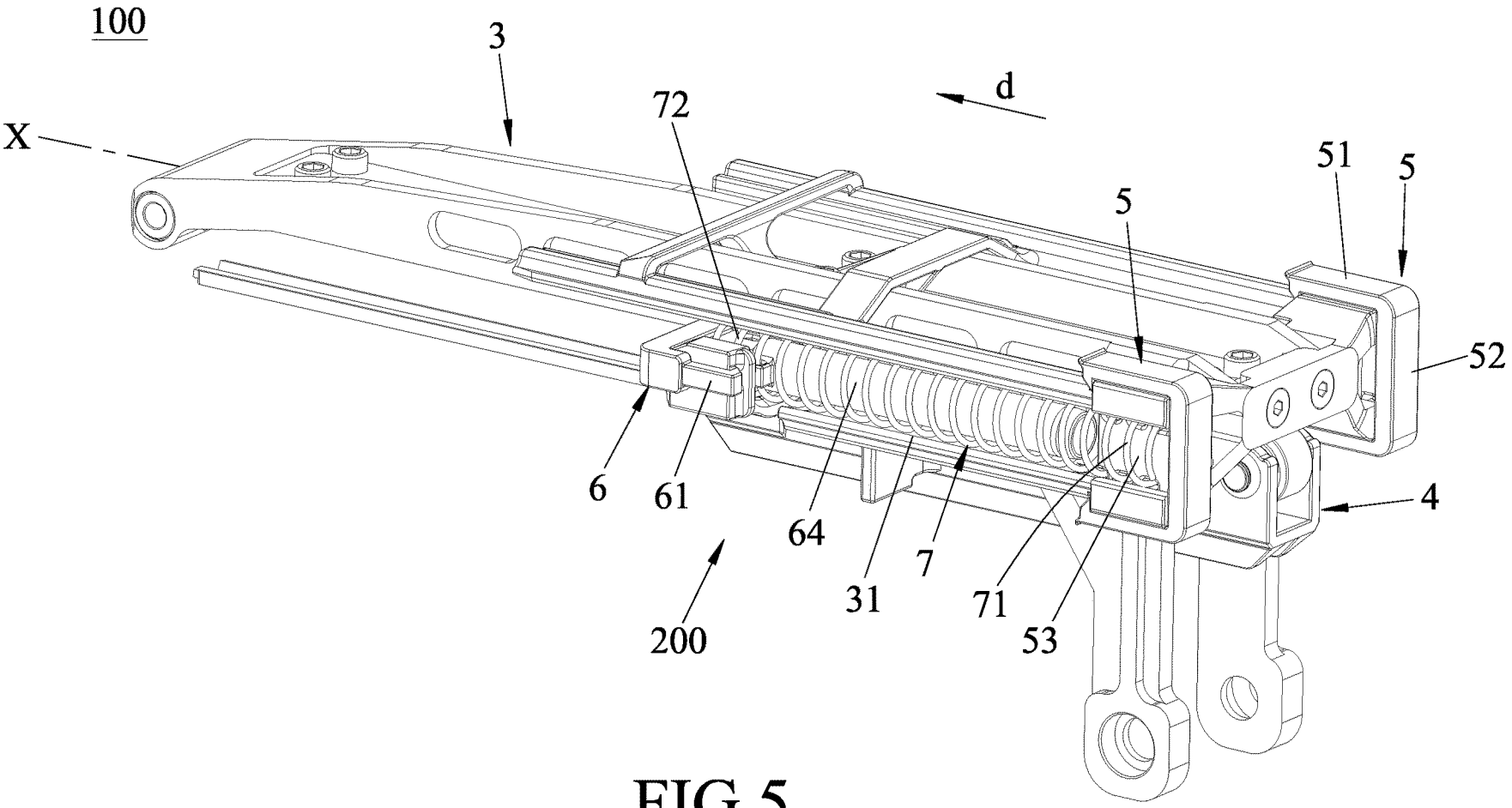
FIG. 5 is an assembled perspective view of the embodiment, illustrating an impact member at a normal position.

Referring to FIGS. 3, 4 and 5, an embodiment of an impact mechanism 100 according to the disclosure is adapted to be installed in an electric nail gun 2. The electric nail gun 2 includes a main frame 21 and a flywheel 22. The main frame 21 has front and rear ends 211, 212 that are opposite in an extending direction (d). The flywheel 22 is rotatably mounted to the main frame 21, and is drivable by electric power to rotate. The impact mechanism 100 includes a swing arm 3, an impact member 4 and an retrieving device 200.

The swing arm 3 is adapted to be connected to the main frame 21, and has an outer surface formed with two track grooves 31 (see FIG. 7) that face oppositely. The impact member 4 is slidably mounted to the swing arm 3. The swing arm 3 is pivotable relative to the main frame 21 to move the impact member 4 to contact the flywheel 22 so that rotation of the flywheel 22 drives the impact member 4 to move forward along an axis (X) that extends in the extending direction (d) from a normal position to a striking position.

Figure 8:
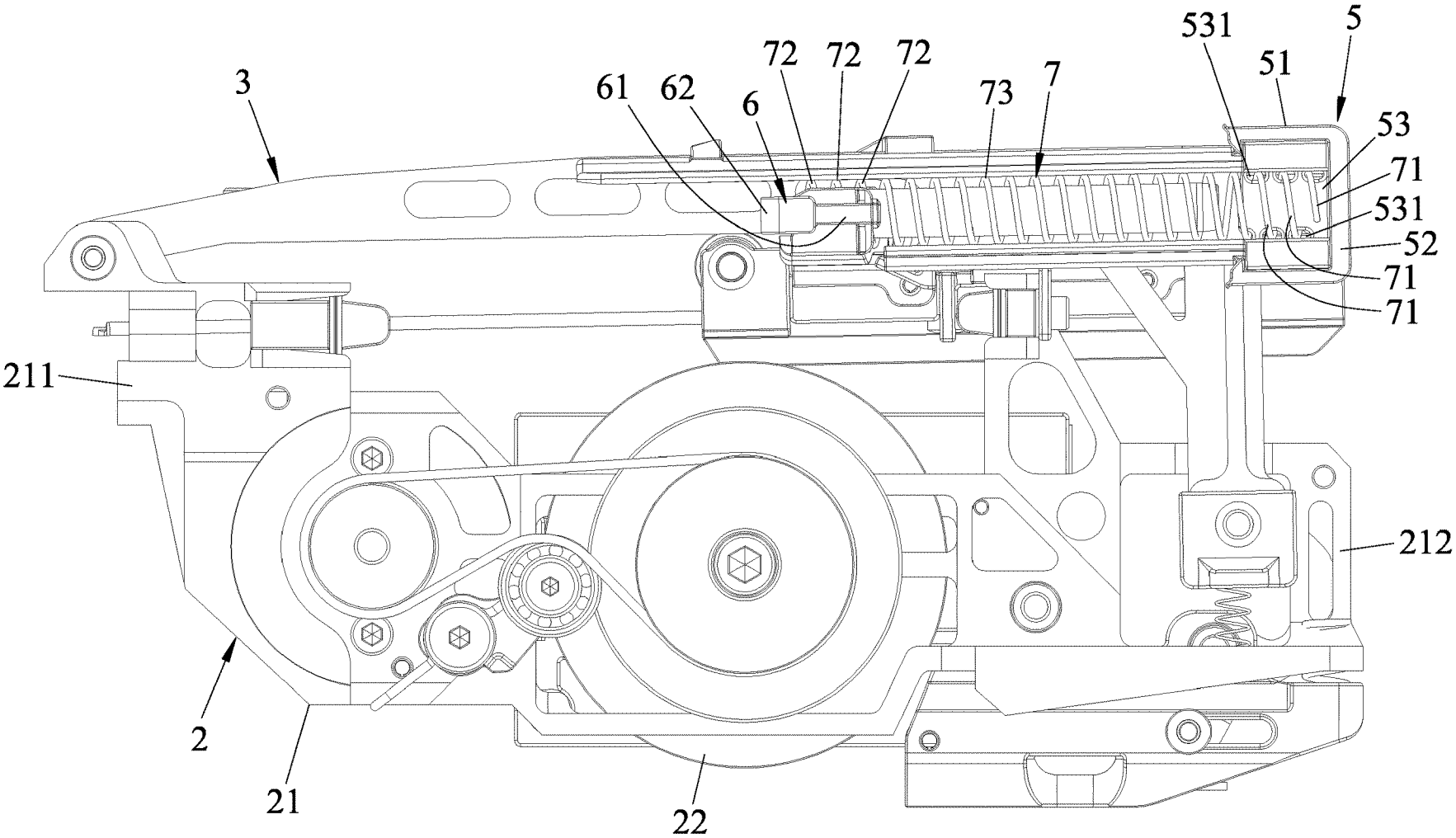
FIG. 8 is a side view of the electric nail gun when the impact member is at the normal position.

Referring further to FIGS. 6, 8 to 10, when the impact member 4 is at the normal position (see FIG. 6), most portion of the impact member 4 is retained in the main frame 21, and a front tip of the impact 4 is proximate to the front end 211 of the main frame 21 (see FIG. 8). When the impact member 4 is at the striking position (see FIG. 9), the impact member 4 extends out of the main frame 21 such that the front tip of the impact member 4 is distal from the front end 211 of the main frame 21 (see FIG. 10) for hammering a nail (not shown).

In this embodiment, the retrieving device 200 is connected to the swing arm 3 and the impact member 4, and includes two stationary seats 5, two moving seats 6 and two resilient components 7.

Each of the stationary seats 5 is connected to the swing arm 3, is proximate to the rear end 212 of the main frame 21, and has two clipping portions 51, a connecting portion 52, and an extending portion 53.

For each of the stationary seats 5, the clipping portions 51 are engaged with the swing arm 3. The connecting portion 52 is connected between the clipping portions 51. The extending portion 53 extends between the clipping portion 51 in the extending direction (d) from the connecting portion 52, and has five stationary elongated holes 531.

The stationary elongated holes 531 of each of the stationary seats 5 are elongated in the extending direction (d), and are arranged in two parallel rows which extend in the extending direction (d).

The moving seats 6 of the retrieving device 200 are co-movably connected to the impact member 4, and are spaced apart from the stationary seats 5 in the extending direction (d). Each of the moving seats 6 has two clipping parts 61, a connecting part 62, an extending part 63 and a guiding part 64.

For each of the moving seats 6, the clipping parts 61 are engaged with the impact member 4. The connecting part 62 is connected between the clipping parts 61. The extending part 63 extends between the clipping parts 61 parallel to the extending direction (d) from the connecting part 62, and has five moving elongated holes 631. The guiding part 64 extends parallel to the extending direction (d) from the extending part 63, is received in a respective one of the track grooves 31 of the swing arm 3 when the impact member 4 is at the normal position, and is moved outside of the respective one of the track grooves 31 when the impact member 4 is at the striking position.

The moving elongated holes 631 of each of the moving seats 6 are elongated in the extending direction (d), and are arranged in two parallel rows which extend in the extending direction (d).

It should be noted that the number of the stationary elongated holes 531 and the number of the moving elongated holes 631 are not limited to five; in variations of the embodiment, they may be one, two, three, four, six or above.

Referring to FIG. 4, in the present embodiment, the resilient components 7 of the retrieving device 200 are extension springs. Each of the resilient components 7 interconnects a respective one of the stationary seats 5 and a respective one of the moving seats 6, and has three first end coils 71, three second end coils 72 and a plurality of intermediate coils 73 that interconnect the first end coils 71 and the second end coils 72.

For each of the resilient components 7, the first end coils 71 extend through the stationary elongated holes 531 of the respective one of the stationary seats 5 and are movable parallel to the axis (X) along the stationary elongated holes 531. The second end coils 72 are opposite to the first end coils 71, extend through the moving elongated holes 631 of the respective one of the moving seats 6, and are movable parallel to the axis (X) along the moving elongated holes 631. The guiding part 64 of each of the moving seats 6 extends through the intermediate coils 73 of a respective one of the resilient components 7.

Figure 6:
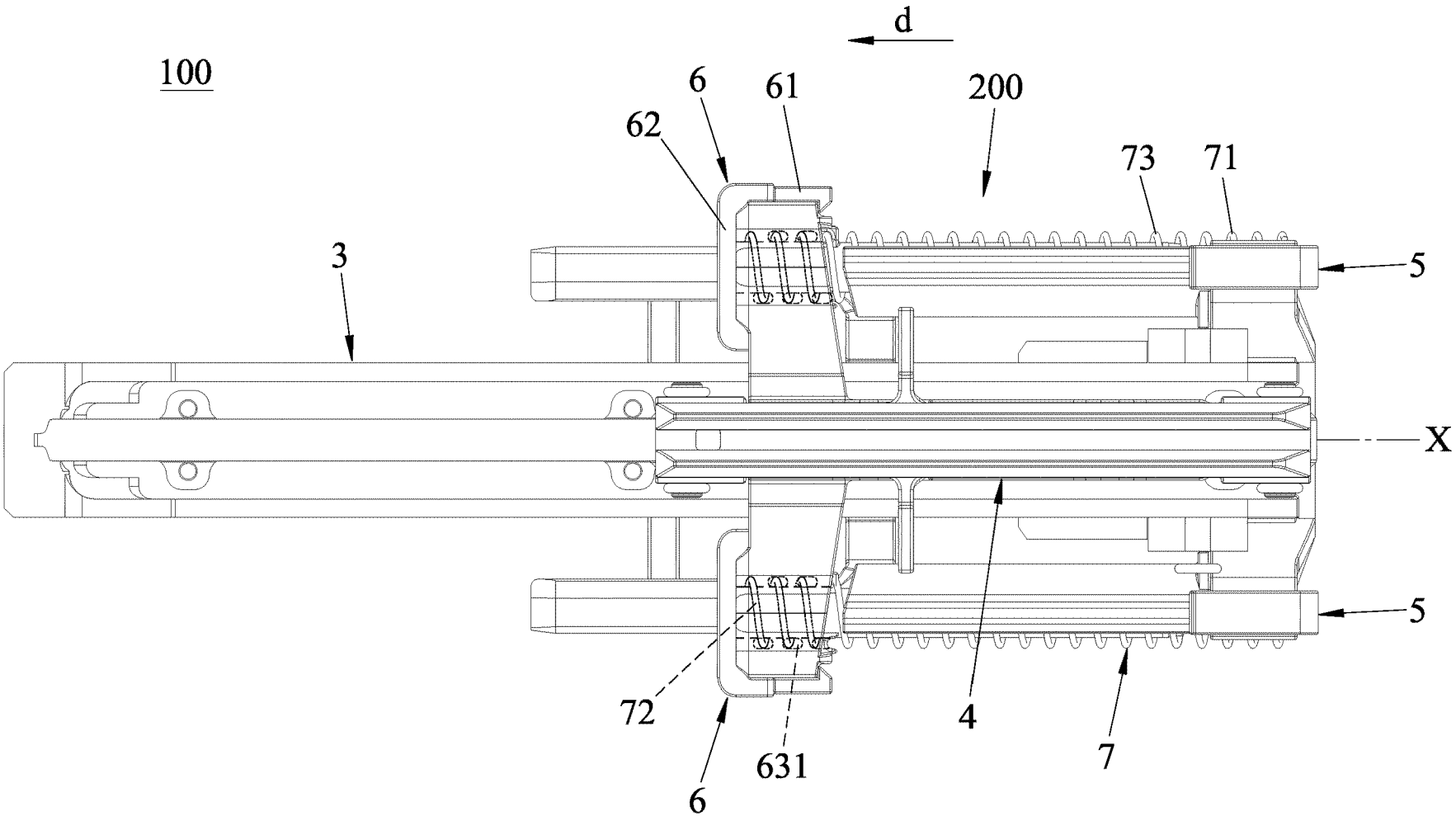
FIG. 6 is a top view of the embodiment when the impact member is at the normal position.
Figure 7:
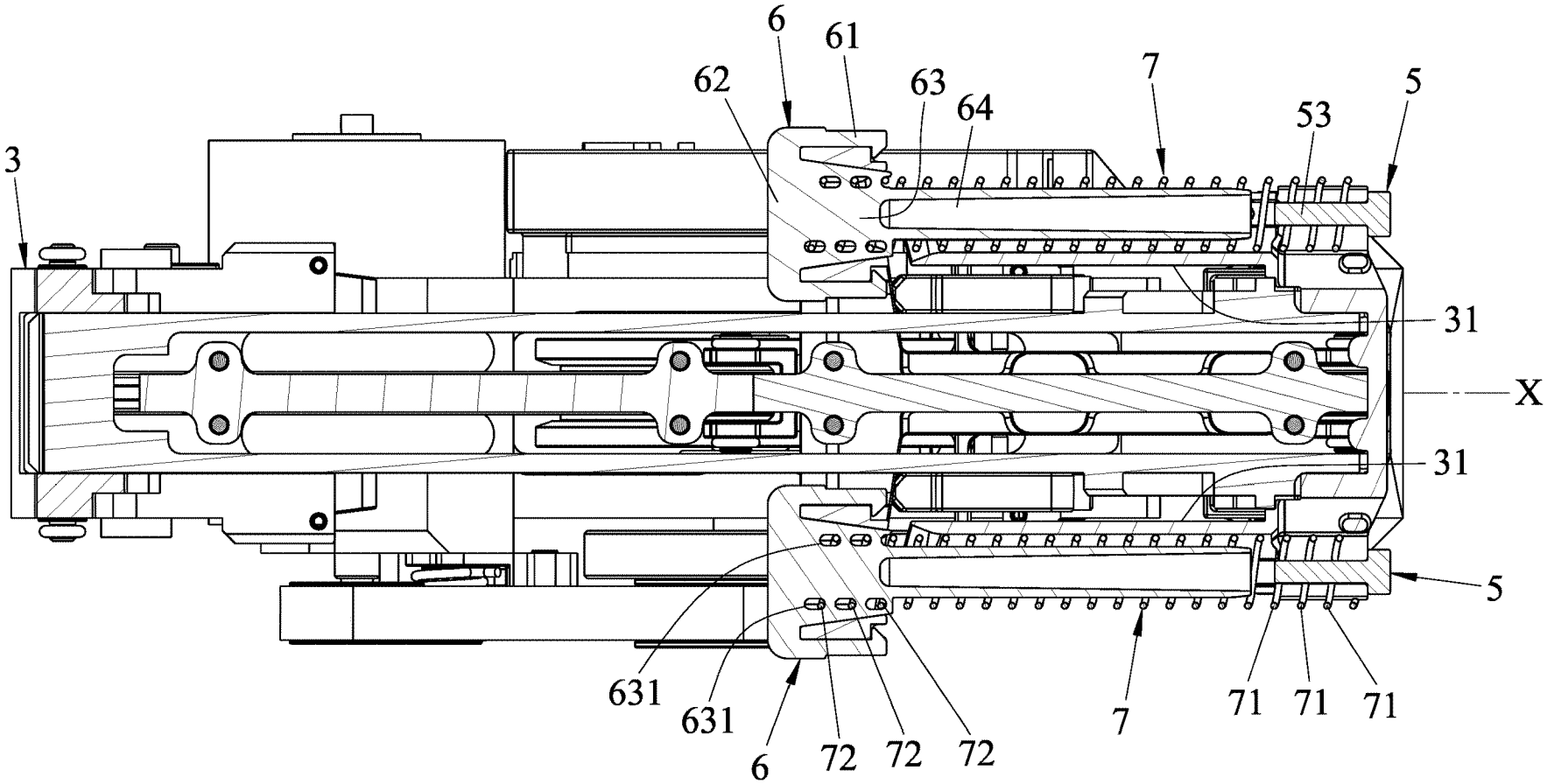
FIG. 7 is a sectional view of the electric nail gun when the impact member is at the normal position.

Referring to FIGS. 6, 7 and 8, when the impact member 4 is at the normal position, the resilient components 7 are relaxed, the moving seats 6 are distal form the front end 211 of the main frame 21, and the guiding parts 64 of the moving seats 6 are received respectively in the track grooves 31 of the swing arm 3.

When the pivotal movement of the swing arm 3 causes the impact member 4 to contact the flywheel 22 during the operation of the electric nail gun 2, a kinetic energy is transmitted from the flywheel 22 to the impact member 4 to actuate a forward movement of the impact member 4. At this very instant, the moving seats 6 are driven to move together with the impact member 4 in high speed. Since the stationary elongated holes 531 and the moving elongated holes 631 are elongated, they are loosely engaged with the first end coils 71 and the second end coils 72 of the resilient members 7, so that the forward movement of the moving seats 6 will result in relative movement between the moving seats 6 and the resilient components 7 before the resilient components 7 are stretched by the moving seats 6. In such a manner, the stationary and moving elongated holes 531, 631 provide a little wiggle room and serve as buffers for the resilient components 7.

Figure 9:
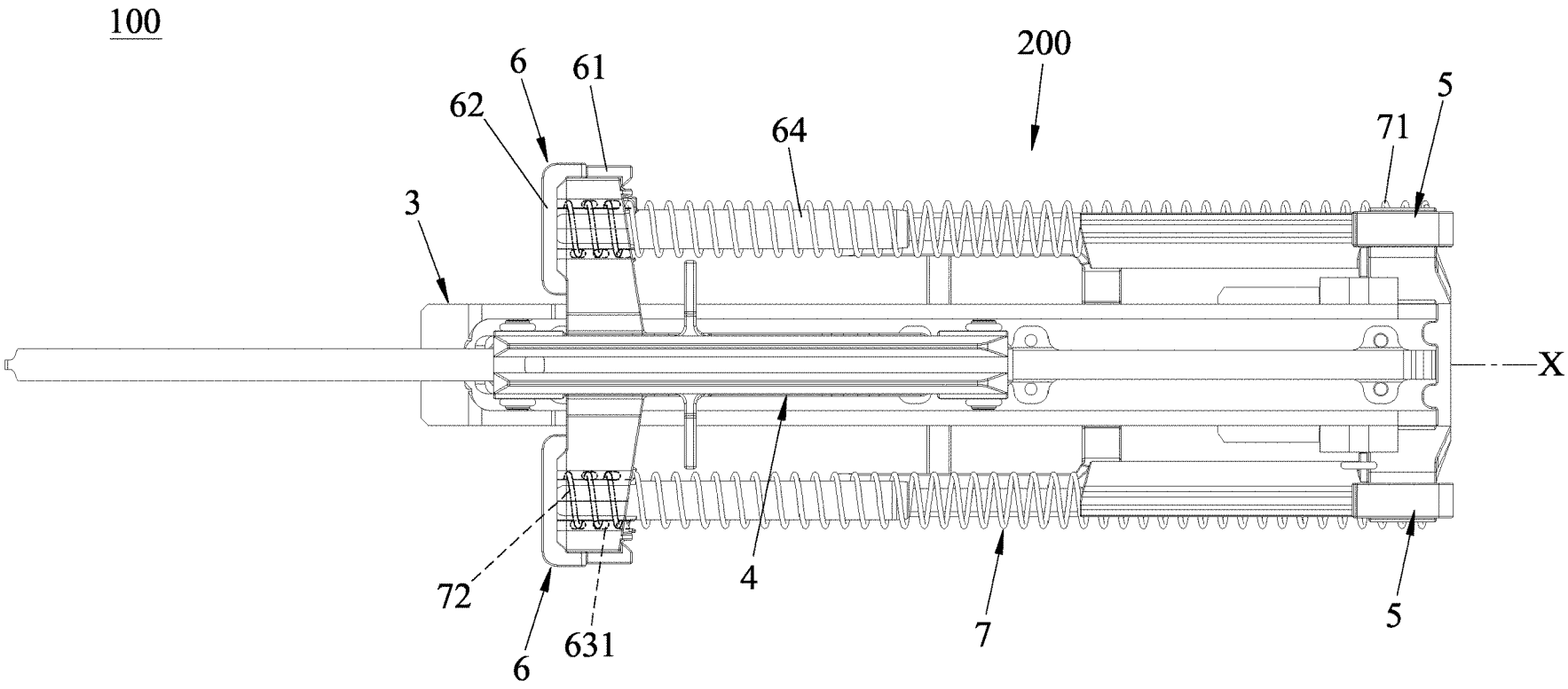
FIG. 9 is a top view of the embodiment when the impact member is at a striking position.
Figure 10:
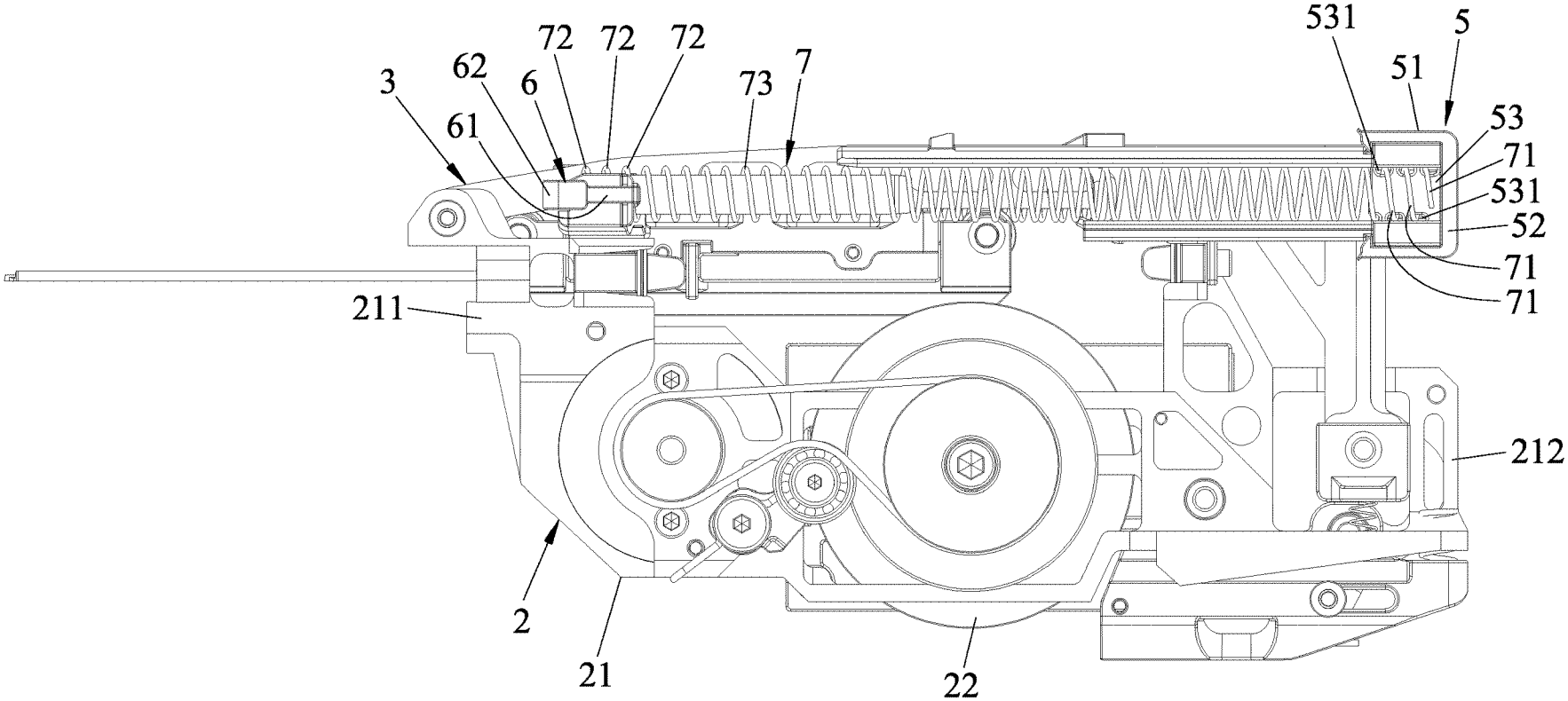
FIG. 10 is a side view of the electric nail gun when the impact member is at the striking position.

Referring to FIGS. 9 and 10, when the impact member 4 arrives at the striking position, the guiding parts 64 of the moving seats 6 are disposed respectively outside of the track grooves 31 of the swing arm 3, and the moving seats 6 are proximate to the front end 211 of the main frame 212.

Once a hammering process of a nail is completed (i.e. the impact member 4 has released the kinetic energy that drives its forward movement), the restoring force of the resilient components 7 pulls the impact member 4 to move back to the normal position, and the moving seats 6 are pulled back with the guiding parts 64 thereof being received respectively in the track grooves 31 of the swing arm 3.

It should also be noted that, numbers of the stationary seats 5, the moving seats 6, and resilient components 7 are not limited to two; in variations of the embodiment, they may be one.

In sum, the impact mechanism 100 of the embodiment according to the disclosure has advantages as follows.

Firstly, by virtue of the stationary and moving elongated holes 531, 631 being elongated in the extending direction (d), the impact of abrupt stretching of the resilient components 7 is dampened, and lifespan of the resilient components 7 is thus extended.

Secondly, since the stationary and moving seats 5, 6 are formed with a plurality of the stationary and moving elongated holes 531, 631, the forces exerted by the stationary and moving seats 5, 6 to the first and second end coils 71, 72 of the resilient components 7 are evenly distributed via engagement between the first and second end coils 71, 72 and the stationary and moving elongated holes 531, 631.

Thirdly, compared with the prior art, in which the slide block 16 is movable relative to the impact member 15 and the stretching of the first resilient members 17 would be affected by the movement of the slide block relative to the impact member 15, there is not relative movement between the moving seats 6 and the impact member 4, the movement of impact member 4 and the stretching of the resilient components 7 are not affected by movement of other elements, and thus are relatively smoother.

Finally, the stationary seats 5, the moving seats and the resilient components 7 form a modular structure that is easily disassemblable and replaceable, which is cost-effective for maintenance.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A retrieving device adapted to be installed in an electric nail gun, the electric nail gun including a main frame, a flywheel that is rotatably mounted to the main frame, and an impact mechanism that includes a swing arm connected to the main frame, and an impact member slidably mounted to the swing arm, the swing arm being pivotable relative to the main frame to move the impact member to contact the flywheel so that rotation of the flywheel drives the impact member to move forward along an axis from a normal position to a striking position, said retrieving device comprising:

at least one stationary seat that is adapted to be connected to the swing arm, and that has at least one stationary elongated hole being elongated in an extending direction of the axis;

at least one moving seat that is adapted to be co-movably connected to the impact member, and that is spaced apart from said at least one stationary seat in the extending direction; and at least one resilient component that interconnects said at least one stationary seat and said at least one moving seat, and that has at least one first end coil extending through said at least one stationary elongated hole and being movable parallel to the axis along said at least one stationary elongated hole;

wherein said at least one moving seat has at least one moving elongated hole being elongated in the extending direction; and wherein said at least one resilient component further has at least one second end coil being opposite to said at least one first end coil, extending through said at least one moving elongated hole, and being movable parallel to the axis along said at least one moving elongated hole.

2. The retrieving device as claimed in claim 1, wherein:

said at least one stationary seat includes two stationary seats, each of said stationary seats having said at least one stationary elongated hole;

said at least one moving seat includes two moving seats, each of said moving seats having said at least one moving elongated hole; and said at least one resilient component includes two resilient components, each of said resilient components having said at least one first end coil, said at least one second end coil, and a plurality of intermediate coils that interconnect said at least one first end coil and said at least one second end coil, said at least one first end coil of each of said resilient components movably extending through said at least one stationary elongated hole of a respective one of said stationary seats, said at least one second end coil of each of said resilient components movably extending through said at least one moving elongated hole of a respective one of said moving seats.

3. The retrieving device as claimed in claim 2, wherein each of said stationary seats has:

two clipping portions that are adapted to be engaged with the swing arm;

a connecting portion that is connected between said clipping portions; and an extending portion that extends in the extending direction from said connecting portion, and that has said at least one stationary elongated hole.

4. The retrieving device as claimed in claim 2, wherein each of said moving seats has:

two clipping parts that are adapted to be engaged with the impact member;

a connecting part that is connected between said clipping parts; and an extending part that extends parallel to the extending direction from said connecting part, and that has said at least one moving elongated hole.

5. The retrieving device as claimed in claim 4, wherein:

each of said moving seats further has a guiding part that extends parallel to the extending direction from said extending part, and that extends through said intermediate coils of a respective one of said resilient components; and said guiding portion of each of said moving seats is adapted to be received in a track groove that is formed in the swing arm when the impact member is at the normal position, and is adapted to be moved outside of the track groove of the swing arm when the impact member is at the striking position.

6. The retrieving device as claimed in claim 1, wherein:

said at least one moving elongated hole of said at least one moving seat includes a plurality of moving elongated holes that are arranged in two parallel rows which extend in the extending direction; and said at least one second end coil of said at least one resilient component includes a plurality of second end coils extending through said moving elongated holes.

7. The retrieving device as claimed in claim 1, wherein:

said at least one stationary elongated hole of said at least one stationary seat includes a plurality of stationary elongated holes that are arranged in two parallel rows which extend in the extending direction; and said at least one first end coil of said at least one resilient component includes a plurality of first end coils extending through said stationary elongated holes.

8. The retrieving device as claimed in claim 1, wherein said at least one resilient component is an extension spring.

9. An impact mechanism adapted to be installed in an electric nail gun, the electric nail gun including a main frame, and a flywheel that is rotatably mounted to the main frame, said impact mechanism comprising:

a swing arm adapted to be connected to the main frame;

an impact member slidably mounted to said swing arm, said swing arm being adapted to be pivotable relative to the main frame to move said impact member to contact the flywheel so that rotation of the flywheel drives said impact member to move forward along an axis from a normal position to a striking position; and said retrieving device as claimed in claim 1 connected to said swing arm and said impact member;

wherein said at least one moving seat has at least one moving elongated hole being elongated in the extending direction; and wherein said at least one resilient component further has at least one second end coil being opposite to said at least one first end coil, extending through said at least one moving elongated hole, and being movable parallel to the axis along said at least one moving elongated hole.

10. The impact mechanism as claimed in claim 9, wherein:

said at least one stationary seat includes two stationary seats, each of said stationary seats having said at least one stationary elongated hole;

said at least one moving seat includes two moving seats, each of said moving seats having said at least one moving elongated hole; and said at least one resilient component includes two resilient components, each of said resilient components having said at least one first end coil, said at least one second end coil, and a plurality of intermediate coils that interconnect said at least one first end coil and said at least one second end coil, said at least one first end coil of each of said resilient components movably extending through said at least one stationary elongated hole of a respective one of said stationary seats, said at least one second end coil of each of said resilient components movably extending through said at least one moving elongated hole of a respective one of said moving seats.

11. The impact mechanism as claimed in claim 10, wherein each of said stationary seats has:

two clipping portions that are engaged with said swing arm;

a connecting portion that is connected between said clipping portions; and an extending portion that extends in the extending direction from said connecting portion, and that has said at least one stationary elongated hole.

12. The impact mechanism as claimed in claim 10, wherein each of said moving seats has:

two clipping parts that are engaged with said impact member;

a connecting part that is connected between said clipping part; and an extending part that extends parallel to the extending direction from said connecting part, and that has said at least one moving elongated hole.

13. The impact mechanism as claimed in claim 12, wherein:

said swing arm has an outer surface formed with two track grooves that face oppositely;

each of said moving seats further has a guiding part that extends parallel to the extending direction from said extending part, and that extends through said intermediate coils of a respective one of said resilient components; and said guiding portion of each of said moving seats is received in a respective one of said track grooves when said impact member is at the normal position, and is moved outside of the respective one of said track grooves when said impact member is at the striking position.

14. The impact mechanism as claimed in claim 9, wherein:

said at least one moving elongated hole of said at least one moving seat includes a plurality of moving elongated holes that are arranged in two parallel rows extending in the extending direction; and said at least one second end coil of said at least one resilient component includes a plurality of second end coils extending through said moving elongated holes.

15. The impact mechanism as claimed in claim 9, wherein:

said at least one stationary elongated hole of said at least one stationary seat includes a plurality of stationary elongated holes that are arranged in two parallel rows extending in the extending direction; and said at least one first end coil of said at least one resilient component includes a plurality of first end coils extending through said stationary elongated holes.

16. The impact mechanism as claimed in claim 9, wherein said at least one resilient component is an extension spring.

* * * * *